US007478615B2

(12) United States Patent
Itoafa et al.

(10) Patent No.: US 7,478,615 B2
(45) Date of Patent: Jan. 20, 2009

(54) AXIAL FIXATION OF A SPRING SUPPORT PART OF A SWITCHABLE TAPPET

(75) Inventors: Calin Petru Itoafa, Höchstadt (DE); Mario Kuhl, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 38 days.

(21) Appl. No.: 11/401,123

(22) Filed: Apr. 10, 2006

(65) Prior Publication Data

US 2006/0225681 A1 Oct. 12, 2006

Related U.S. Application Data

(60) Provisional application No. 60/670,558, filed on Apr. 11, 2005.

(51) Int. Cl.
*F01L 1/14* (2006.01)

(52) U.S. Cl. ..... 123/90.48; 123/90.16; 123/90.52

(58) Field of Classification Search ..... 123/90.48, 123/90.49, 90.52, 90.55, 90.65, 90.67, 90.16
See application file for complete search history.

(56) References Cited

U.S. PATENT DOCUMENTS 2,677,933 A * 5/1954 Hopkinson ..... 60/370
5,400,695 A * 3/1995 Walker ..... 92/128
6,106,637 A * 8/2000 Arnaud et al. ..... 148/320
6,564,764 B2 * 5/2003 Karbstein et al. ..... 123/90.48
6,802,288 B2 10/2004 Spath

FOREIGN PATENT DOCUMENTS

| | | |
|---|---|---|
| DE | 3219206 | 12/1982 |
| DE | 3714723 | 11/1988 |
| DE | 10342642 | 5/2005 |
| EP | 1526255 | 4/2005 |

* cited by examiner

*Primary Examiner*—Zelalem Eshete
(74) *Attorney, Agent, or Firm*—Volpe and Koenig, P.C.

(57) ABSTRACT

The invention relates to an axial fixation (17) of a spring support part (9) of a switchable tappet (1) for direct transmission of a cam stroke to a tappet push-rod (7) of a valve drive of an internal combustion engine. The tappet (1) has an inner part (3), which receives the force of a spring means (13), in that the spring support part (9) used as a support (12) for the spring means (13) is fixed axially to the inner part (3) in a direction of force of the spring means (13), such that the spring support part (9) and the inner part (3) face each other in a region of the axial fixation (17) and form a common channel (18) by means of formed parts (20, 23) aligned with each other, in which a retaining ring (19) is arranged for positive-fit connection of the spring support part (9) to the inner part (3). The retaining ring (19) is formed from a wire (24), which can be inserted essentially tangentially into the annular channel (18) through an opening (25) arranged in the inner part (3) or in the spring support part (9) and opening into the annular channel (18).

5 Claims, 2 Drawing Sheets

AXIAL FIXATION OF A SPRING SUPPORT PART OF A SWITCHABLE TAPPET

CROSS-REFERENCE TO RELATED APPLICATIONS

This application claims the benefit of U.S. Provisional Application No. 60/670,558, filed Apr. 11, 2005, which is incorporated herein by reference as if fully set forth.

FIELD OF THE INVENTION

The invention relates to an axial fixation of a spring support part of a switchable tappet for direct transmission of a cam stroke to a tappet push-rod of a valve drive of an internal combustion engine. The tappet has an inner part, which receives the force of a spring means, and the spring support part with a support for the spring means is fixed at least axially in a force direction of the spring means to the inner part, such that the spring support part and the inner part in the region of the axial fixation encompass each other and form a common annular channel by means of matching formed parts. A retaining ring for positive-fit connection of the spring support part with the inner part is arranged in this annular channel.

BACKGROUND OF THE INVENTION

Switchable tappets, which have spring means, as well as a spring support part, that is fixed axially at least in the force direction of the spring means to an inner part of the tappet with the help of a retaining ring forming a positive fit, are known in the state of the art. These tappets are used for turning off or switching the transmission of one or more cam strokes to a tappet push-rod of a valve drive of an internal combustion engine. For this purpose, such tappets have an inner part that can telescope relative to an outer part. The inner part can be locked to the outer part through a locking mechanism. To maintain contact between cam and tappet parts, whose movement in the unlocked state is not transmitted to the gas-exchange valve, a spring means is mounted between the inner part and the outer part.

Thus, in U.S. Pat. No. 6,802,288 B2, which is considered as class-defining, a switchable roller tappet is provided, as used more and more in large-volume V-engines with bottom camshafts and tappet push-rods as a valve drive-side basis for turning off cylinders as a measure for reducing the fuel consumption of the internal combustion engine. During decoupled outer part functioning, the tappet push-rod connected to the inner part remains stationary, wherein the mass action starting from the movement of the outer part is received by a so-called lost-motion spring. This spring is mounted between the outer part and a spring support part, which is fixed axially to the inner part by a retaining ring. Especially for switchable roller tappets according to the noted document, very high demands in terms of functional reliability, installation space, and assembly ease are placed on the axial fixation of the spring support part to the inner part. Thus, initially according to the relatively high mass of the outer part of the roller tappet, a lost-motion spring with high work capacity is to be used with simultaneously high spring forces, which the retaining ring must transmit to the inner part with resistance to wear and defects over the service life of the internal combustion engine. However, due to the very limited installation space available for the switchable roller tappet, which may typically be built no larger than a conventional non-switchable roller tappet, the axial fixation and thus the retaining ring and its surroundings are to be dimensioned as small as possible. In addition, the axial fixation is to be embodied so that it allows process-sure assembly.

With respect to these conditions and due to lack of detailed information, someone skilled in the art would understand from the noted document that the shown retaining ring involves a snap ring, which is lowered completely into an annular groove of the spring support part during assembly of the spring support part, in order to then snap into a corresponding annular groove of the inner part and to interact with this part in a positive fit. However, the assembly-related requirement of complete lowering of the retaining ring into the annular groove requires, on one hand, a sufficiently flexible retaining ring, thus with small cross-sectional dimensions, and, on the other hand, a sufficient radial play of the retaining ring in the annular groove of the spring support part. Both lead to an accumulation of high material stresses, because the small cross-sectional retaining ring as a rule snaps eccentrically into the annular groove of the inner part and consequently only small sections of its periphery are available for force transmission. In this respect, this type of axial fixation of the spring support part in connection with a switchable roller tappet is viewed as disadvantageous since the resulting large and pulsing forces cannot be transmitted permanently with sufficient reliability.

OBJECT OF THE INVENTION

Therefore, the objective of the invention is to create an axial fixation of a spring support part of a switchable tappet and a method for creating such an axial fixation, in which the cited disadvantage is overcome with simple means. Accordingly, the axial fixation should mainly guarantee the functional reliability of the tappet over the service life of the internal combustion engine. Simultaneously, the axial fixation should require the smallest possible installation space and finally should also allow process-sure assembly.

SUMMARY OF THE INVENTION

According to the invention, this objective is met by a device such that the securing ring is formed from an essentially straight wire, which can be inserted essentially tangentially into the annular channel through an opening, which is arranged in the inner part or in the spring support part and which opens into the annular channel. Thus, the use of a retaining ring with a sufficiently large cross section is possible, which, moreover, can transmit the resulting axial forces over its entire length. In this respect, the previously mentioned disadvantage is overcome with simple means and an axial fixation for a switchable tappet is created, which distinguishes itself through high functional reliability and assembly ease with minimal installation space requirements.

The work capacity and the spring forces of the spring means can be maximized in a useful improvement of the invention, such that the opening, in which the retaining ring can be inserted, is located in the inner part, which has a hollow cylindrical shape in a region of the axial fixation and encloses the spring support part with an inner sleeve surface. In addition, the spring support part should be formed of thin-walled lightweight construction material, such as sheet metal, and should be expanded conically in common with the spring means in a direction of the tappet push-rod. Therefore, because the spring support part is arranged within the inner part, has a thin-walled configuration, and is expanded conically in common with the spring means, it can represent a spring means, formed, for example, as a helical compression spring with largest possible wire cross section and optimum force-path characteristic line. This satisfies the requirements of the switchable tappet in the deactivated state with simultaneously minimal installation room requirements.

For axial fixation of the spring support part provided in this way, it is also proposed that an end of the spring support part facing the inner part forms an axial stop for a piston top part supported in the inner sleeve surface of the inner part so that it can move longitudinally. Through this advantageous configuration, the path limitation typically embodied as a snap ring is eliminated for the piston top part, whereby the number of components, the assembly expense, as well as the costs of the tappet, are reduced.

In terms of low manufacturing and assembly expense, it is further proposed that the wire has a circular cross section. Here, it is further advantageous for the function of the retaining ring and the assembly of the wire forming the retaining ring in the annular channel if the wire is formed of a cold-hammered metal, which, on one hand, can transmit high axial forces continuously and, on the other hand, can be introduced into the annular channel with low resistance.

The axial fixation according to the invention is preferably manufactured in the following steps according to the method. At first, the spring support part and the inner part are assembled in a relative position, in which the parts form the common annular channel for holding the retaining ring, and are held in this position. Then a first end section of the wire forming the retaining ring is fed, threaded through the opening into the annular channel, and inserted tangentially into the annular channel.

Finally, for the production of the axial fixation according to assembly, it can be advantageous if the wire is taken off a wire roll and cut into sections according to an arc length of the retaining ring only after insertion into the annular channel. Through these measures, the expense for the handling, which can be sizable for the removal, feed, and assembly of already sectioned wires, can be significantly reduced. The invention is explained in more detail using the following embodiment.

BRIEF DESCRIPTION OF THE DRAWINGS

In the enclosed drawings, details of the axial fixation according to the invention are illustrated using an embodiment of a switchable roller tappet. Shown are.

DETAILED DESCRIPTION OF THE PREFERRED EMBODIMENTS

Figure 1:
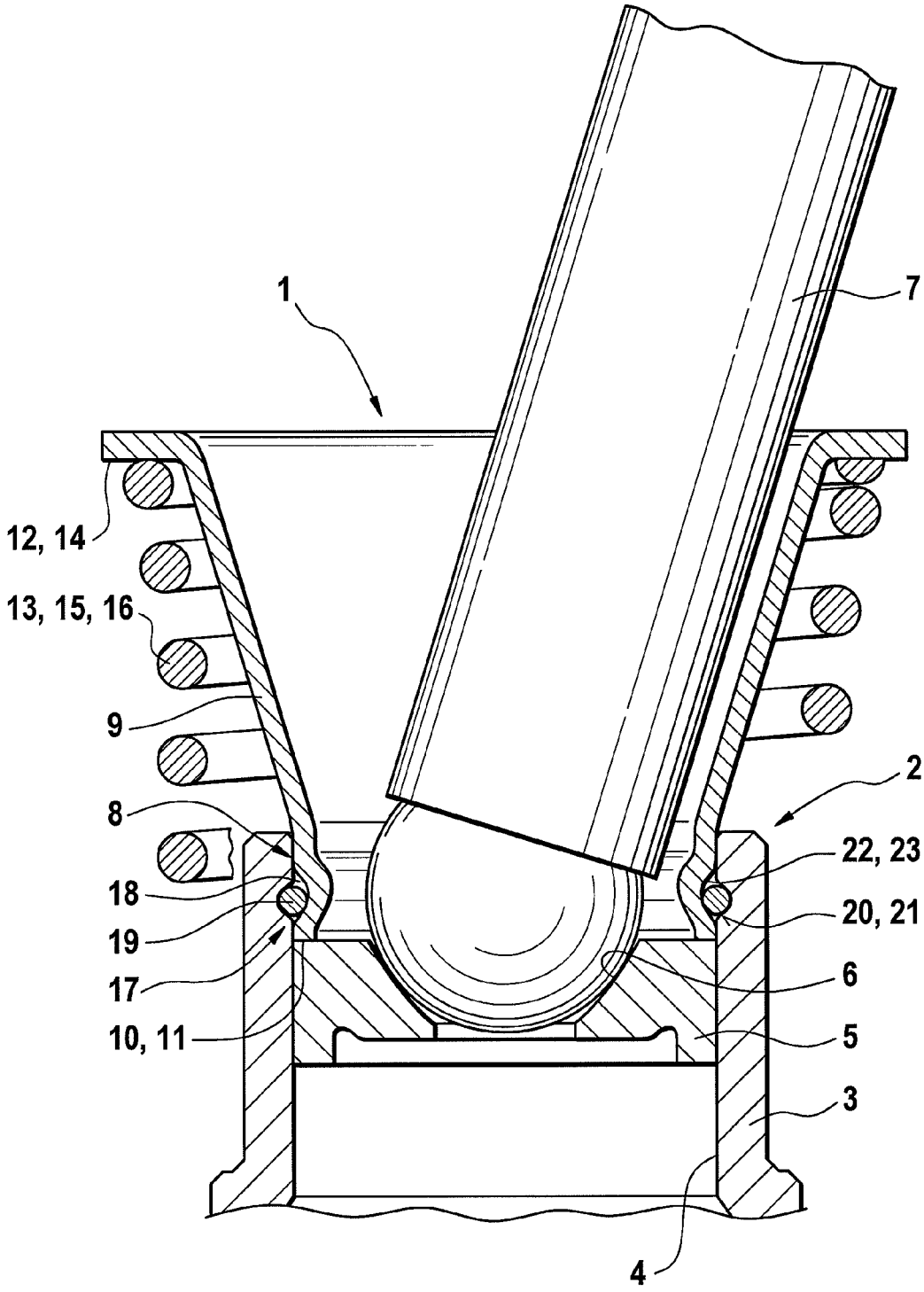
FIG. 1 is a view of the axial fixation in assembled state.

FIG. 1 shows a detail section that is essential for the invention for a switchable tappet 1 of a tappet push-rod valve drive of an internal combustion engine. In principle, the tappet 1 is configured as a switchable flat tappet or roller tappet, as known to someone skilled in the art, for example, from the previously noted U.S. Pat. No. 6,802,288 B2 or also from DE 101 23 964 A1. An end section away from the cam for a hollow cylindrical inner part 3 of the tappet 1 is shown. A piston top part 5, which is used with a dome-shaped formed part 6 for articulated bearing of a tappet push-rod 7, is guided movable longitudinally in an inner sleeve surface 4 of the inner part 3. Furthermore, the inner sleeve surface 4 encloses an end section 8 of a spring support part 9 facing the piston top part 5. Here, an end surface 10 of the spring support part 9 facing the piston top part 5 is used as an axial stop 11 for the piston top part 5.

The spring support part 9 is expanded conically starting from the end section 8 in a direction of the tappet push-rod 7 and finally transitions into an annular surface 14 used as support 12 for a spring means 13. The spring means 13 is used as a lost-motion spring 15, which is mounted between the inner part 3 and a not-shown outer part of the switchable tappet 1 and which is configured as a helical compression spring 16. The installation space available for the lost-motion spring 15 is maximized so that the spring support part 9 is arranged next to its conical form within the inner sleeve surface 4 and is formed of thin-walled sheet metal. Consequently, the lost-motion spring 15 can be embodied, on one hand, with a large wire cross section and, on the other hand, with a similar conical coil, which is beneficial to an optimum force-path characteristic line according to the characteristics of the switchable tappet 1.

Figure 2:
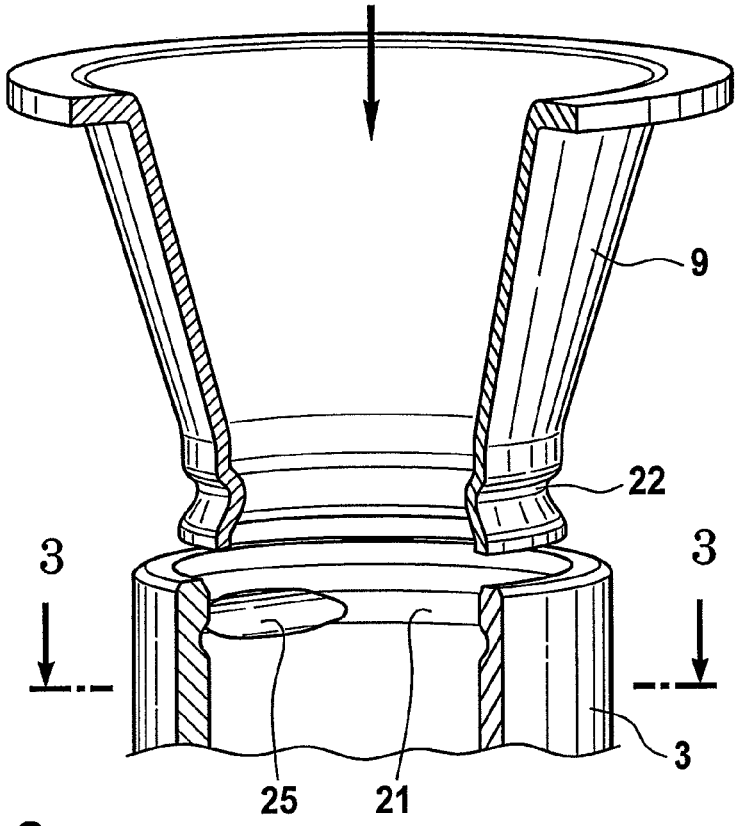
FIG. 2 is an exploded view of the spring support part and inner part of the tappet.
Figure 3:
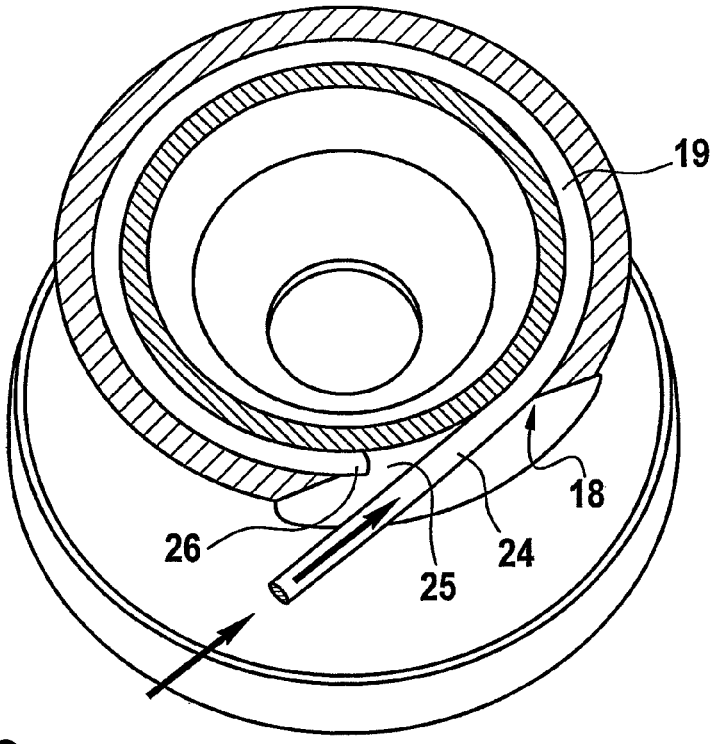
FIG. 3 is a view showing the axial fixation during the assembly process according to section A-A from FIG. 2.

The longitudinal connection of the spring support part 9 to the inner part 3 is realized by axial fixation 17, which encloses a retaining ring 19 arranged in an annular channel 18. The annular channel 18 is formed by a formed part 20 in the shape of an annular groove 21 running in the inner sleeve surface 4 of the inner part 3, as well as a formed part 23 aligned with the annular groove 21 and also provided as an annular groove 22 in the spring support part 9. Thus, a positive-fit axial securing device 17 is created, which acts both in and also opposite the direction of force of the lost-motion spring 15. As shown in FIGS. 2 and 3, an opening 25 that opens into the annular groove 21 of the inner pat 3 is used for assembling a wire 24 forming the retaining ring 19. The wire 24 can be inserted tangentially through the opening 25 into the annular channel 18 according to the steps described below for producing the axial fixation 17.

As indicated in FIG. 2, at first the spring support part 9 and the inner part 3 are assembled in a relative position, in which the annular grooves 21 and 22 are aligned with each other and form the common annular channel 18, and are held in this position. FIG. 3 shows the section A-A from FIG. 2 for an inner part 3 and spring support part 9 positioned relative to each other. Here, a first end section 26 of the wire 24 is fed and threaded through the opening 25 into the annular channel 18. Then the retaining ring 19 is formed through tangential insertion of the wire 24 into the annular channel 18. According to the preferred embodiment, here the elongated wire 24 is unwound from a wire roll and cut into sections according to an arc length of the retaining ring 19 only after the insertion into the annular channel 18. Alternatively, it is also possible to feed, thread, and insert a wire already cut to the arc length of the retaining ring 19.

LIST OF REFERENCE SYMBOLS

1 Tappet
2 End section
3 Inner part
4 Inner sleeve surface
5 Piston top part
6 Molded part
7 Tappet push-rod
8 End section
9 Spring support part
10 End surface
11 Axial stop
12 Support
13 Spring means

14 Annular surface
15 Lost-motion spring
16 Helical compression spring
17 Axial fixation
18 Annular channel
19 Retaining ring
20 Formed part
21 Annular groove
22 Annular groove
23 Formed part
24 Wire
25 Opening
26 End section

The invention claimed is:

1. Axial fixation arrangement for a spring support part of a switchable tappet for direct transmission of a cam stroke to a tappet push-rod of a valve drive of an internal combustion engine, comprising the tappet including an inner part, which receives a force of a spring means, the spring support part acts as a support for the spring means and is fixed axially at least in a direction of force of the spring means to the inner part, the spring support part and the inner part enclose in a region of the axial fixation a common annular channel defined by formed parts thereof which are aligned with each other, in which a retaining ring is arranged for positive-fit connection of the spring support part with the inner part, the retaining ring is formed from an essentially straight wire, inserted essentially tangentially into the annular channel through an opening located in the inner part, which has a hollow cylindrical shape in a region of the axial fixation with an inner sleeve surface enclosing the spring support part, the spring support part is comprised of thin-walled lightweight material, and is expanded conically in common with the spring means in a direction of the tappet push-rod, wherein an end surface of the spring support part facing the inner part forms an axial stop for a longitudinally movable piston top part supported in the inner sleeve surface of the inner part.

2. Axial fixation arrangement according to claim 1, wherein the wire has a circular cross section.

3. Axial fixation arrangement according to claim 2, wherein the wire comprises a cold-hammered metal.

4. Method for producing an axial fixation for a spring support part of a switchable tappet for direct transmission of a cam stroke to a tappet push-rod of a valve drive of an internal combustion engine, in which the tappet includes an inner part, which receives a force of a spring means, the spring support part acts as a support for the spring means and is fixed axially at least in a direction of force of the spring means to the inner part, the spring support part and the inner part enclose in a region of the axial fixation a common annular channel defined by formed parts thereof which are aligned with each other, in which a retaining ring is arranged for positive-fit connection of the spring support part with the inner part, the retaining ring is formed from an essentially straight wire with a generally constant cross-section, inserted into the annular channel through an opening arranged in the inner part or in the spring support part and opening into the annular channel, comprising at least the following steps:

a) assembling the spring support part and the inner part in a relative position, in which the formed parts form the common annular channel for holding the retaining ring, and holding the parts in this position, b) feeding and threading a first end section of the wire forming the retaining ring through the opening into the annular channel and tangentially inserting of the wire into the annular channel while the spring support part and the inner part are held in position.

5. Method according to claim 4, further comprising taking the wire from a wire roll and cutting the wire into sections after insertion into the annular channel according to an arc length of the retaining ring.

* * * * *